US006877461B2

(12) United States Patent
Long et al.

(10) Patent No.: US 6,877,461 B2
(45) Date of Patent: Apr. 12, 2005

(54) PORTABLE INSTANT HOT WATER HEATER

(75) Inventors: Norris Richard Long, Wichita, KS (US); Gary Israel, Andover, KS (US)

(73) Assignee: The Coleman Company, Inc., Wichita, KS (US)

( * ) Notice: Subject to any disclaimer, the term of this patent is extended or adjusted under 35 U.S.C. 154(b) by 0 days.

(21) Appl. No.: 10/223,203

(22) Filed: Aug. 19, 2002

(65) Prior Publication Data

US 2004/0031449 A1 Feb. 19, 2004

(51) Int. Cl.[7] ..... F24H 9/20

(52) U.S. Cl. ..... 122/14.1; 122/14.2; 122/14.3; 122/14.31; 122/18.1; 122/18.2

(58) Field of Search ..... 122/13.01, 14.1, 122/14.2, 14.3, 14.31, 18.1, 18.2; 222/461, 484, 498, 538, 548, 550

(56) References Cited

U.S. PATENT DOCUMENTS

| | | | | | |
|---|---|---|---|---|---|
| 3,597,588 | A | * | 8/1971 | Kirschner et al. | 392/452 |
| 3,741,195 | A | | 6/1973 | Ellis | |
| 4,136,731 | A | * | 1/1979 | DeBoer | 165/257 |
| 4,246,764 | A | * | 1/1981 | Papadakos | 62/183 |
| 4,287,879 | A | * | 9/1981 | Roark | 126/591 |
| 4,558,207 | A | | 12/1985 | Litterst | |
| 4,583,495 | A | * | 4/1986 | Hill et al. | 122/251 |
| 4,811,870 | A | * | 3/1989 | Bianco | 222/461 |
| 4,826,594 | A | * | 5/1989 | Sedman | 210/266 |
| 4,947,025 | A | * | 8/1990 | Alston et al. | 392/481 |
| 4,948,947 | A | | 8/1990 | Kang | |
| 5,201,651 | A | * | 4/1993 | Niksic et al. | 431/12 |
| 5,208,520 | A | | 5/1993 | Sawato et al. | |
| 5,220,877 | A | | 6/1993 | Redovian | |
| 5,277,343 | A | * | 1/1994 | Parsonage | 222/484 |
| 5,385,298 | A | * | 1/1995 | Griggs | 237/1 R |
| 5,460,161 | A | | 10/1995 | Englehart et al. | |
| 5,772,405 | A | | 6/1998 | Eller | |
| 5,785,067 | A | | 7/1998 | Kosofsky | |
| 6,106,494 | A | | 8/2000 | Saravia et al. | |
| 6,152,707 | A | | 11/2000 | Alberg | |
| 6,354,511 | B1 | * | 3/2002 | Hardee | 237/19 |
| 6,628,894 | B2 | | 9/2003 | Winter et al. | |
| 2001/0047541 | A1 | | 12/2001 | Johns | |

FOREIGN PATENT DOCUMENTS

| | | |
|---|---|---|
| DE | 538 361 | 11/1931 |
| FR | 2 542 854 A | 9/1984 |
| GB | 2 289 323 A | 11/1995 |
| GB | 2 341 667 A | 3/2000 |

OTHER PUBLICATIONS

Copy of Invitation to Pay Additional Fees with partial international search (Annex) by the EPO (Oct. 28, 2003).

* cited by examiner

*Primary Examiner*—Jiping Lu
(74) *Attorney, Agent, or Firm*—Leydig, Voit & Mayer, Ltd.

(57) ABSTRACT

A portable instant water heater. Water is delivered to a base unit of the instant hot water heater by a pump that draws water from a reservoir through a flow control valve. The water flows into a pre-heater that wraps around a base of the burner and that is heated by the burner. Water is heated in a heat exchanger and then exits the base unit through an outlet spout that swings out from the base unit to dispense water and that may be stored and locked into position in a handle for the base unit. The flow control valve may lower the flow of water through the heat exchanger, so the water has more time to absorb heat and to get hotter. The base unit includes a single control knob that turns on the pump and the burner and operates the flow control valve.

21 Claims, 8 Drawing Sheets

PORTABLE INSTANT HOT WATER HEATER

TECHNICAL FIELD OF THE INVENTION

The present invention is directed to an instant hot water heater, and more specifically, a portable instant hot water heater.

BACKGROUND OF THE INVENTION

Camping and tailgating are popular recreational activities enjoyed by many. Some people camp so that they may enjoy the outdoors, and others use camping as an inexpensive alternative to staying in hotels. Tailgating is a great way to meet and eat before ball games, and has become quite the ritual for many season ticket holders.

Although many campers enjoy being in the outdoors, often campers like to enjoy the luxuries of home while camping. For example, many campers bring lounge chairs or hammocks, portable air mattresses or cots, and similar items to make a camping experience more comfortable. Similarly, people often like to enjoy home luxuries while tailgating.

One item that most campers and tailgaters have to learn to do without is the availability of hot water. Most homes are equipped with running hot water, supplied by a hot water heater that is connected with the home plumbing. The user simply turns on a faucet, and after a short delay, hot water is supplied. The hot water may be used for bathing, cleaning, cooking, or washing clothes.

In a camping or tailgating environment, if a user desires hot water, the user must obtain water, for example, from a faucet or other water source, and place the water in a container over a fire, such as a camp stove or an open fire. The water must then be heated to a desired temperature. This process typically takes several minutes, and water temperatures that are obtained using this process are relatively imprecise. The water that has been heated is hard to dispense because it is in a heated pot and the pots often are not designed for pouring. Also, if a user desires a lot of heated water, the process must be repeated until enough hot water is produced. Moreover, a user risks overheating the water to a point where it is dangerous to handle, especially for children.

In practice, because the process for preparing and obtaining heated water is so difficult when camping or tailgating, most users typically wash dishes, prepare food, and wash their face and hands with unheated water. Typically, the users will heat water only as necessary for food preparation and for making instant coffee and tea, for example.

SUMMARY OF THE INVENTION

The present invention provides an instant water heater that utilizes a flame, for example, produced by a propane burner. The instant hot water heater is fully portable, and may be used, for example, in camping or tailgating environments. The instant hot water heater is configured to deliver varying degrees of hot water, for example ranging from 90° to 150°, instantaneously. The hot water heater is designed to operate regardless of the temperature of source water. Hot water from the instant hot water heater may be used for many applications, including but not limited to, washing dishes, food preparation, making coffee and tea, and washing face and hands.

Water is delivered to a base unit of the instant hot water heater by a pump that is attached to the base unit by a hose. The pump may draw water from a reservoir or other water source. Alternatively, water may be provided by a conventional hose or another water source.

The base unit includes a burner and a fuel source, such as a propane cylinder. A conventional igniter, such as is used for propane lanterns, may be provided for lighting a flame in the burner.

The pump delivers water to the base and into and through a flow control valve. From the flow control valve, the water flows into a pre-heater and then into a heat exchanger. The pre-heater includes a structure that wraps around a base of the burner and that is heated by the burner. This structure heats the water prior to the water entering the heat exchanger, increasing efficiency of the water heating process, and reducing the possibility of condensation being formed at the heat exchanger.

The heat exchanger is heated by the burner, and the water flows through coils that are embedded in the heat exchanger. Water exiting the heat exchanger is heated to a temperature that is ready for use.

Water exits the base unit through an outlet spout that resembles a kitchen faucet spout. The spout swings out from the base unit to dispense water. The spout may be stored and locked into position in a handle for the base unit, and may be swung out for use.

A flow control system controls the amount of water flowing through the base unit so that the water may be heated to a desired level for a user. By lowering the flow of water through the heat exchanger, the water has more time to absorb heat and to get hotter.

The base unit includes a single control knob that turns on the pump and the burner and operates the flow control valve. In a first portion of movement of the control knob (e.g., a first quarter-turn of the control knob), the pump and a control circuit for the base unit are turned on. In a second portion of movement of the control knob (e.g., a second quarter-turn of the control knob), the burner is turned on. Further movement in the second portion adjusts the output of the burner. The burner reaches full output at the end of the second portion. At a third portion of movement of the control knob (e.g., a third quarter-turn of the control knob), the burner remains at the highest output setting, but the flow control valve is adjusted to reduce the flow of water. The reduced flow of water allows the water to absorb more heat, raising the temperature of the water. In this manner, adjusting the single control knob provides a range of temperatures for the output water depending upon how much the handle has been turned.

The base unit also includes an over temperature circuit that has a sensing element and a solenoid. The sensing element, which may be a thermistor, sends a signal to the solenoid as a result of the water exceeding a particular temperature. This condition may occur, for example, if water is no longer being supplied by the pump (i.e., the reservoir is empty.) As a result of the signal, the solenoid shuts off fuel to the burner, preventing boiling water from exiting the spout. Other safety devices may be employed, such as a device for sensing the tilt of the base unit and shutting off the burner as a result of too much tilt, a flow sensing switch that shuts off the burner if there is no or low water flow, or a flame control that senses the presence of a flame in the burner, and absent such a flame, cuts fuel to the burner.

The instant hot water heater of the present invention is fully portable, and may be used in remote locations, such as for camping or for tailgating. Its function and operation are very easy to understand, and setting up the unit takes a minimal amount of time.

Other advantages will become apparent from the following detailed description when taken in conjunction with the drawings, in which:

DETAILED DESCRIPTION

In the following description, various aspects of the present invention will be described. For purposes of explanation, specific configurations and details are set forth in order to provide a thorough understanding of the present invention. However, it will also be apparent to one skilled in the art that the present invention may be practiced without the specific details. Furthermore, well-known features may be omitted or simplified in order not to obscure the present invention.

Figure 1:
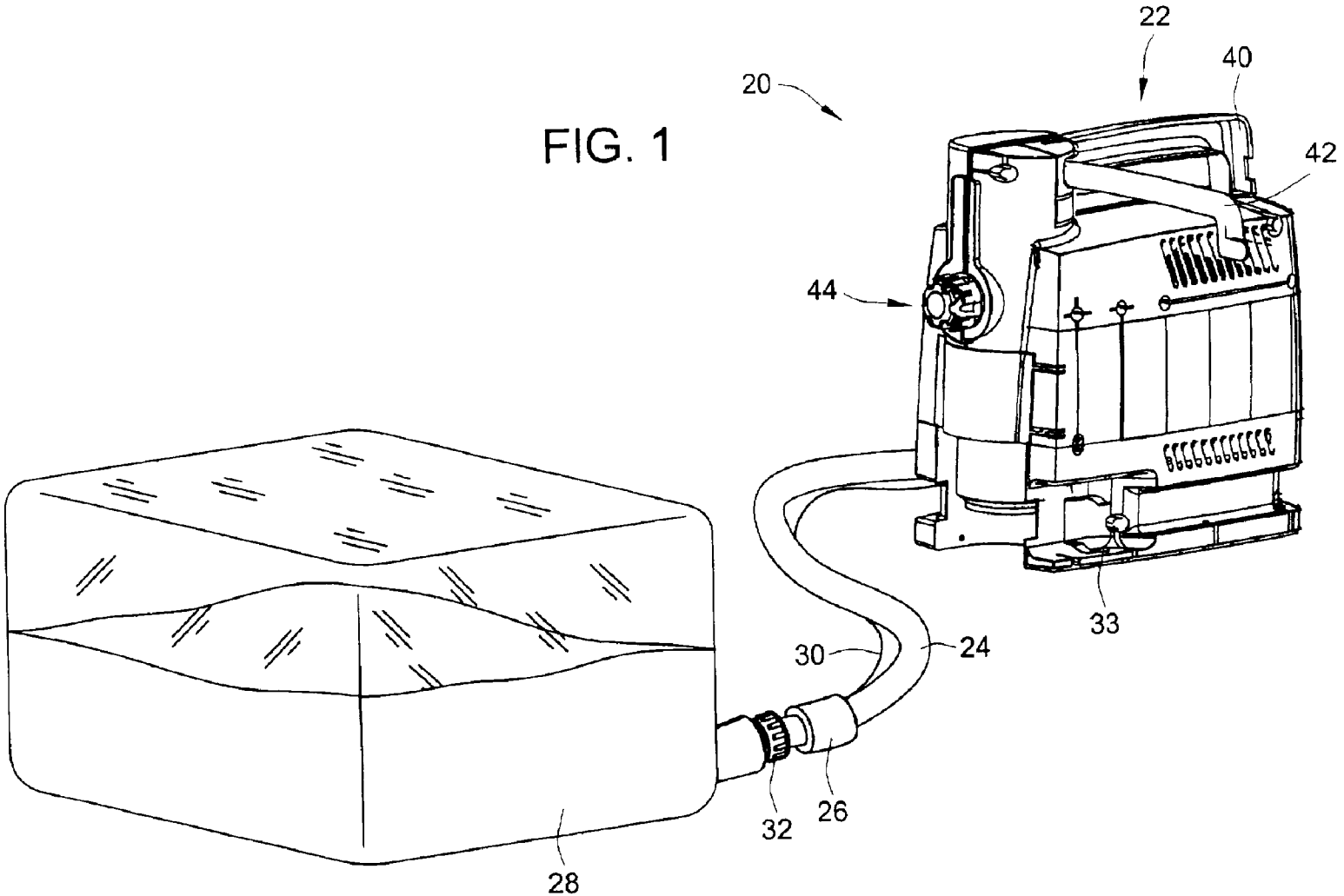
FIG. 1 is an isometric view showing an instant hot water heater in accordance with the present invention, with a spout for a base unit of the instant hot water heater extending outward, and a pump for the instant hot water heater connected to a water reservoir.

Referring now to the drawings, in which like reference numerals represent like parts throughout the several views, FIG. 1 shows an instant hot water heater 20 in accordance with the present invention. The instant hot water heater includes a base unit 22 attached by a hose 24 to a pump 26. In the embodiment shown, the pump 26 is attached to a reservoir 28. A wire 30 extends between the pump 26 and the base unit 22 for providing power to the pump. For the embodiment shown, a coupling 32 is provided at a distal end of the pump 26 for attaching the pump 26 to the reservoir 28.

In operation, as further described below, the pump 26 draws water from the reservoir 28 through the hose 24 and into the base unit 22. The base unit 22 heats the water and provides the heated water at an outlet, for example, a spout 42.

Figure 2:
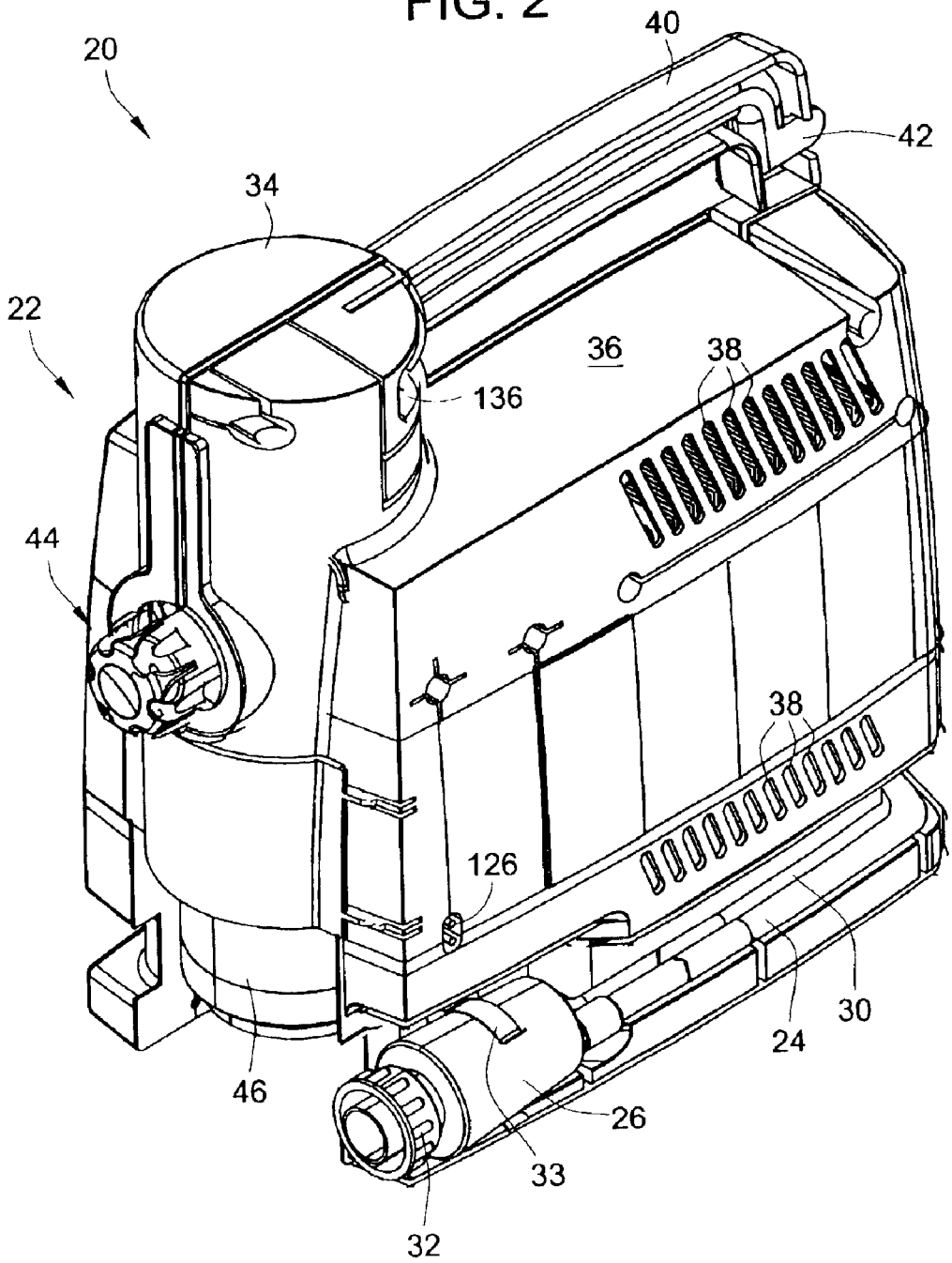
FIG. 2 is a front right isometric view of the instant hot water heater of FIG. 1, showing the pump and the spout in storage positions.

To store the instant hot water heater 20, as shown in FIG. 2, the hose 24 may be wrapped around the bottom portion of the base unit 22, and the pump 26 may be snapped onto a snap ring 33. The spout 42 is pressed into a handle 40 for the base unit 22, as is further described below.

The pump 26 and the reservoir 28 may alternatively be replaced by a conventional water hose or another water source that provides a flow of water. If a water hose is used, a regulator or other flow control device may be needed to control the flow of water into the base unit.

The base unit 22 includes left and right outer casings 34, 36 that fit together in a clam shell fashion. The right outer casing 36 is shown removed in FIG. 3 so that details of the internal components of the base unit 22 may be seen.

Vents 38 (FIG. 2) are provided outside of the base unit 22 for allowing heat to escape the unit. The handle 40 is integrated into the top portion of the base unit. The handle 40 extends horizontally along the top of the base unit 22, and is attached at front and rear sections of the base unit. The spout 42 may be stored in a cavity that extends the length of the handle. The spout 42 is hollow and is rotatably mounted at one end to the base unit 22. As can be seen in FIG. 1, the spout may be rotated out so that it is accessible for dispensing heated water from the base unit 22.

A control knob 44 is located on the front of the base unit 22. The control knob 44 is configured so that it controls operation of the instant hot water heater 20. As further described below, the control knob 44 is capable of turning on the pump 26 and other components of the instant hot water heater, and controlling the water output temperature of the base unit 22.

Figure 3:
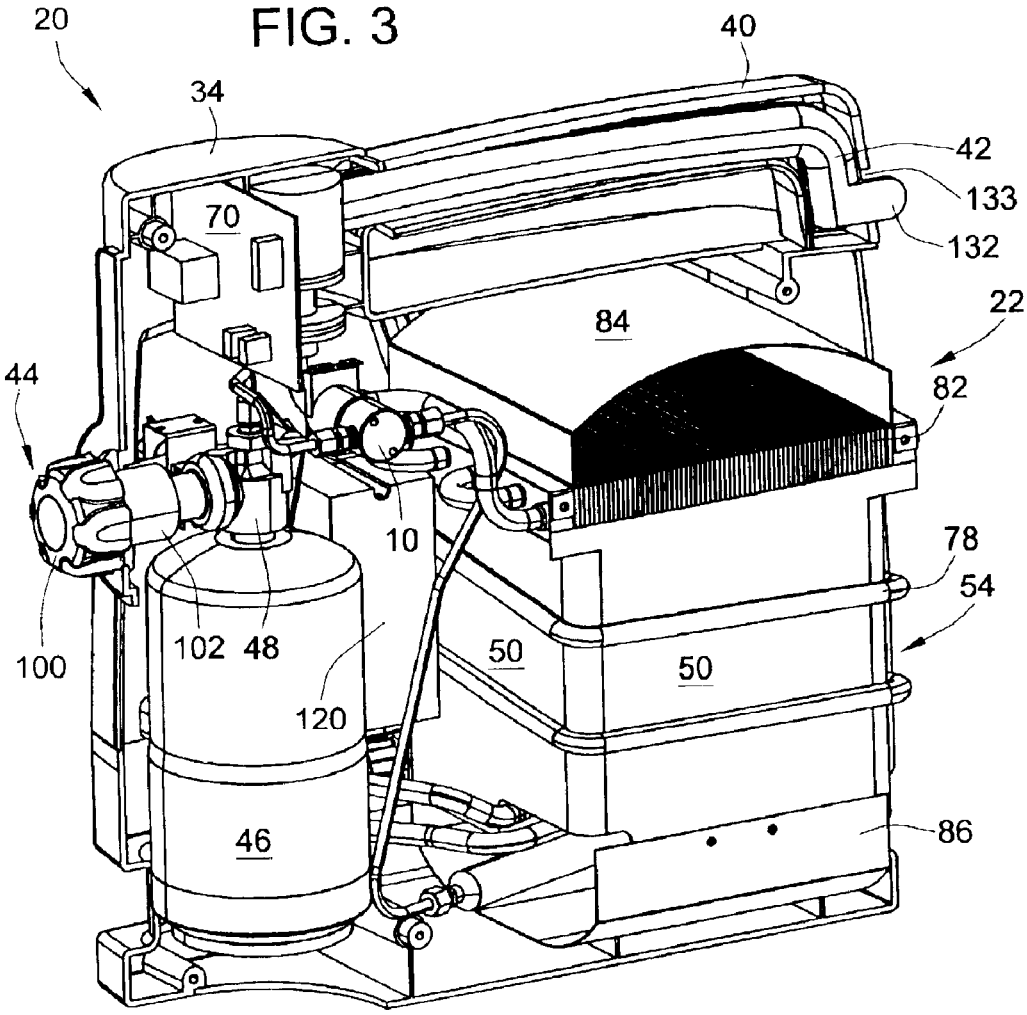
FIG. 3 is a front right, isometric view of the instant hot water heater of FIG. 1, with parts removed for detail.

Turning now to FIG. 3, a propane tank 46, such as a 16.4 oz. COLEMAN brand propane cylinder, is mounted inside the base unit 22. The propane tank 46 is threaded into the bottom of a regulator 48. The regulator 48 controls the flow of fuel from the propane tank 46 to a solenoid valve 50. The regulator 48 includes female threads (not shown) for fitting onto the threaded top of the propane tank 46. The regulator 48 is designed in a manner known in the art to control the amount of propane exiting the propane tank 46. Fuel released by the regulator 48 flows through the solenoid valve 50 to a burner 52, best shown in FIG. 5. The burner 52 provides the flame for a heat exchanger assembly 54 (FIG. 3).

The solenoid valve 50 is in a normally open position, and is connected to a printed circuit board 70. The printed circuit board 70 includes necessary controls to instruct the solenoid valve 50 to close, as further described below.

Figure 5:
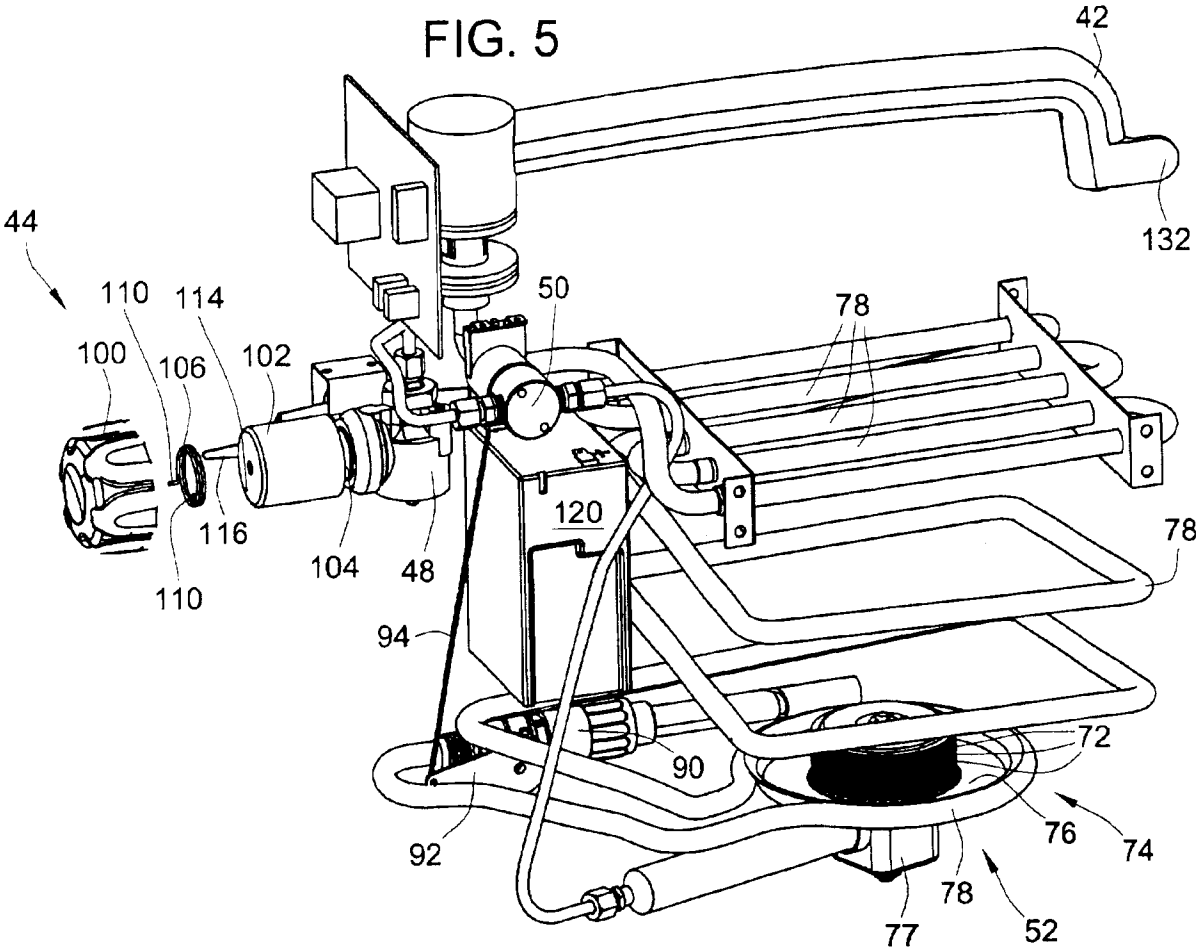
FIG. 5 is a right front, isometric view of the some internal components of the instant hot water heater of FIG. 1.

The burner 52 includes burner rings 72 (FIG. 5). Extra burner rings 72 may be provided to provide a higher Btu output and to keep noise level to a minimum. For example, the burner rings 72 may be stacked 3 times higher than in a conventional camp stove so as to allow higher heat output.

A pre-heater assembly 74 is provided that is attached to the burner 52. The pre-heater assembly 74 includes a copper plate 76 that is placed between the burner rings and a burner base 77. Although described as copper, the copper plate 76 may be formed of another suitable conductive material.

The copper plate 76 is surrounded by conductive tubing 78. The conductive tubing 78 may be, for example a ⅜" diameter copper tube.

The heat exchanger assembly 54 includes sides 80 (FIGS. 3 and 4) that extend up and around the burner 52. A heat exchanger 82 having heating fins is mounted at the top of the sides 80. An upper heating shield 84 extends over the heat exchanger 82. A lower heating shield 86 extends around a bottom of the heat exchanger assembly 54 and under the burner 52.

The routing of the conductive tubing 78 is shown in FIG. 5. The walls of the heat exchanger assembly 54 and the fins of the heat exchanger 82 have been removed to show detail. One end of the conductive tubing 78 extends from the pre-heater assembly 74 around the walls or sides 80 of the heat exchanger assembly 54 (shown wrapping around these walls in FIGS. 3 and 4) and into the heat exchanger 82. The conductive tubing 78 then makes a circuitous path through the heat exchanger 82, as best shown in FIG. 5. An end of the conductive tubing 78 extends into the bottom of the spout 42.

Figure 6:
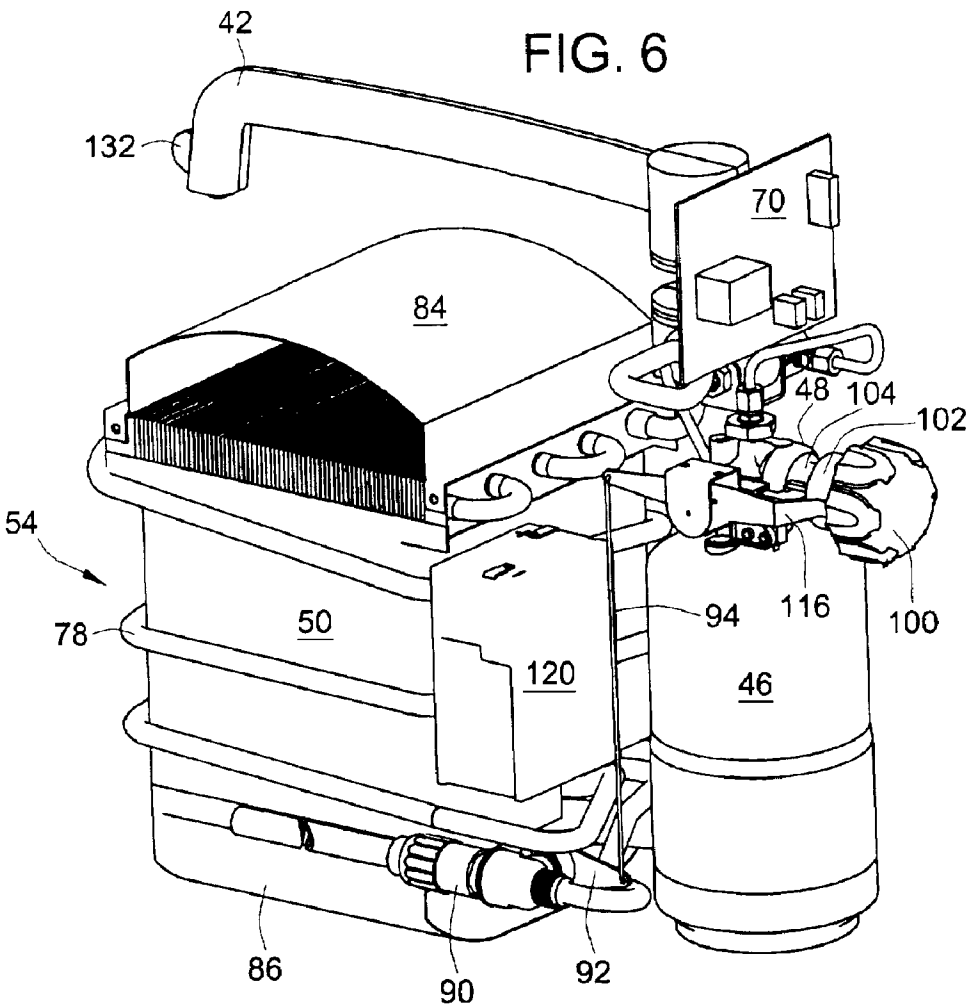
FIG. 6 is a left front, isometric view of the instant hot water heater of FIG. 1, with parts removed for detail.
Figure 7:
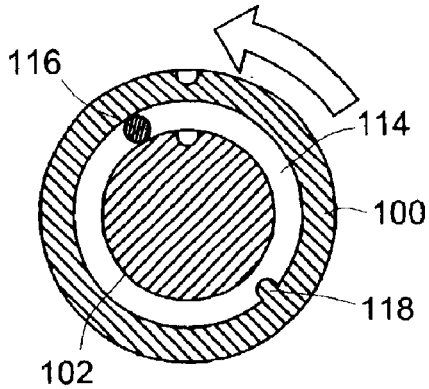
FIGS. 7–10 are diagrammatic representation of a cross-section of a control knob for use with the instant hot water heater of FIG. 1, the figures showing various stages of rotation of the control knob.

The opposite end of the conductive tubing 78 that leads from the pre-heater assembly 74 extends to a flow control valve 90 (best shown in FIG. 6). The flow control valve 90 is mounted to receive water from the pump 26 via the hose 24. The flow control valve 90 is in a normally open position and includes a rocker arm lever 92. A push rod 94 is connected to the rocker arm lever 92. The flow control valve 90 also includes a return spring (not shown, but known in the art) for biasing the flow control valve 90 in the open position and a low flow stop (also not shown) to prevent complete closure of the flow control valve 90.

Details of the control knob 44 can be seen in FIG. 5. The control knob 44 includes an outer knob 100 and an inner knob 102. The outer knob 100 is mounted over and around the inner knob 102. The inner knob 102 is mounted on a regulator shaft 104 for the regulator 48. A torsion spring 106 fits between the inner knob 102 and the outer knob 100. The torsion spring 106 fits into a pocket (not shown) in the rear of the outer knob 100. Spring clip ends 110 of the torsion spring 106 fit into holes 112 on the inner knob 102 and outer knob 100 (the hole on the back of the outer knob is not shown, but is similar to the hole 112), respectively.

A gap 114 (FIGS. 7–10) is defined between the inner sidewall of the outer knob 100 and the outer sidewall of the inner knob 102. An end of a flow valve lever 116 (shown in full in FIG. 6, and a cross section of the end of which is shown in FIGS. 7–10) extends into the gap 114 between the inner knob 102 and the outer knob 100. The flow valve lever 116 is pivotably mounted to the base unit 22, for example to a side of the regulator 48. A forward end of the flow valve lever 116 extends outward toward the control knob 44 and bends at a first angle and then at a second angle so as to straighten back parallel to the rest of the flow valve lever 116. This end of the flow valve lever 116 is seated in the gap 114 between the inner knob 102 and the outer knob 100. The opposite end of the flow valve lever 116 is attached to the push rod 94 that in turn is attached to the rocker arm lever 92 of the flow control valve 90.

A protrusion 118 (FIGS. 7–10) is fixed on the inside surface of the outer knob is located in the gap between the outer knob 100 and the inner knob 102. When the control knob 44 is in a normally closed position, the protrusion 118 is located approximately halfway around the outer knob 100 from the flow valve lever 116. The function of the protrusion 118 is described further below.

Figure 11:
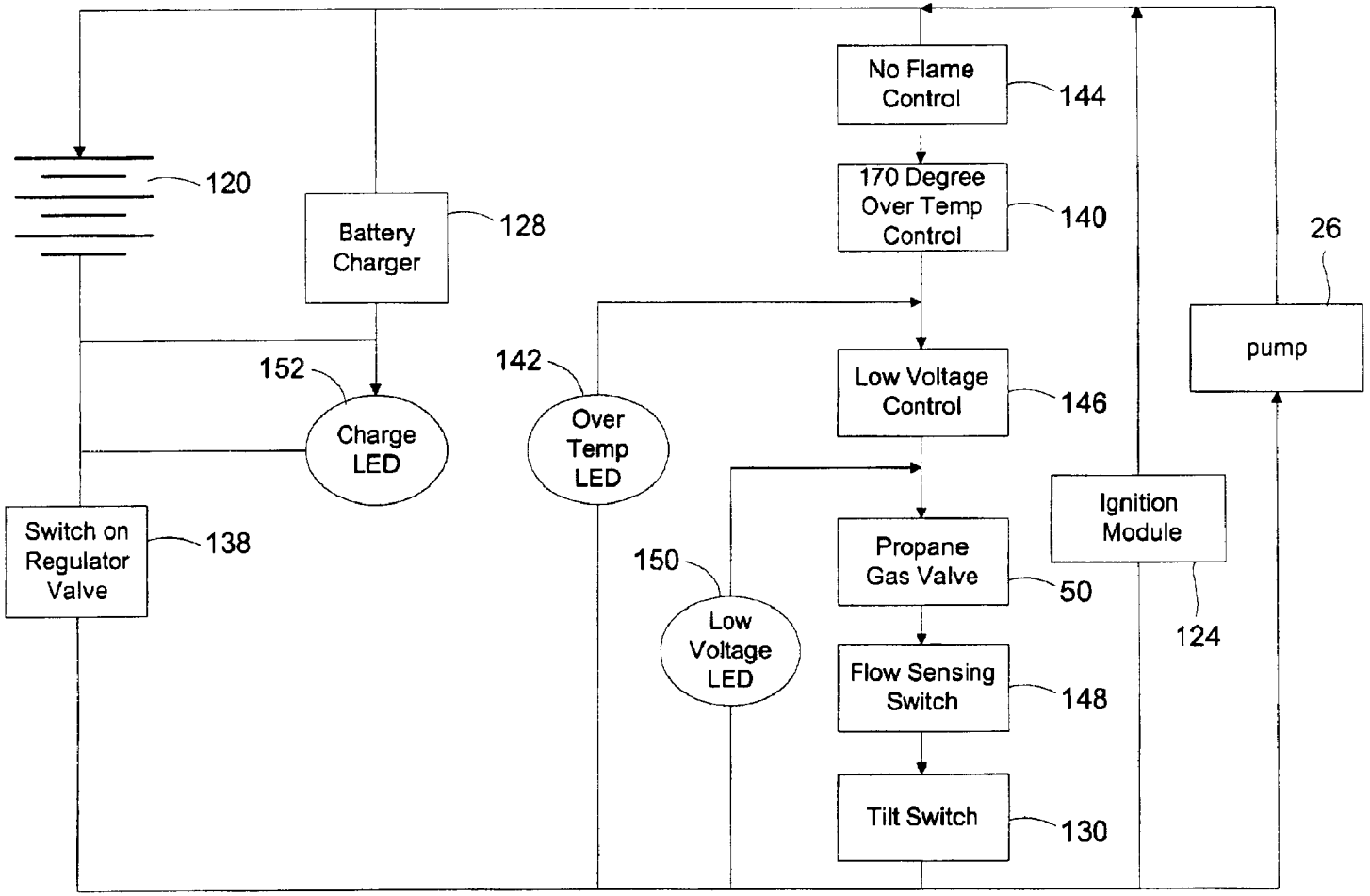
FIG. 11 is a schematic drawing of controls for the present invention.

A battery 120 is mounted in the base unit 22. The battery 120 is connected to the printed circuit board 70, the pump 26, an ignition module 124 (FIG. 11) for the burner 52, and the solenoid valve 50. If desired, the battery may include an integral or connected battery charger 128 (FIG. 11). If so, an AC connector port 126 may be supplied on the outer shell of the base unit 22 for supplying power to the battery charger.

Operation of the instant hot water heater 20 may be understood with reference to the previous description and the circuit diagram at FIG. 11. To set up the instant hot water heater 20, a user disconnects the pump 26 from the snap ring 33 and unwinds the hose 24 from around the bottom of the base unit 22. The coupling 32 on the pump 26 is attached to a water source, such as the reservoir 28. Preferably, the instant hot water heater 20 is placed on a level surface. By doing so, a flame in the burner 52 extends upward to the heat exchanger 82, and there is no risk of overheating the wrong components in the instant hot water heater 20. To this end, a tilt sensor or switch 130 (FIG. 11) may be provided that is in a normally closed position, and that when the base unit 22 is not within a particular range of being level (e.g., +/−30 degrees), the switch is closed.

Figure 4:
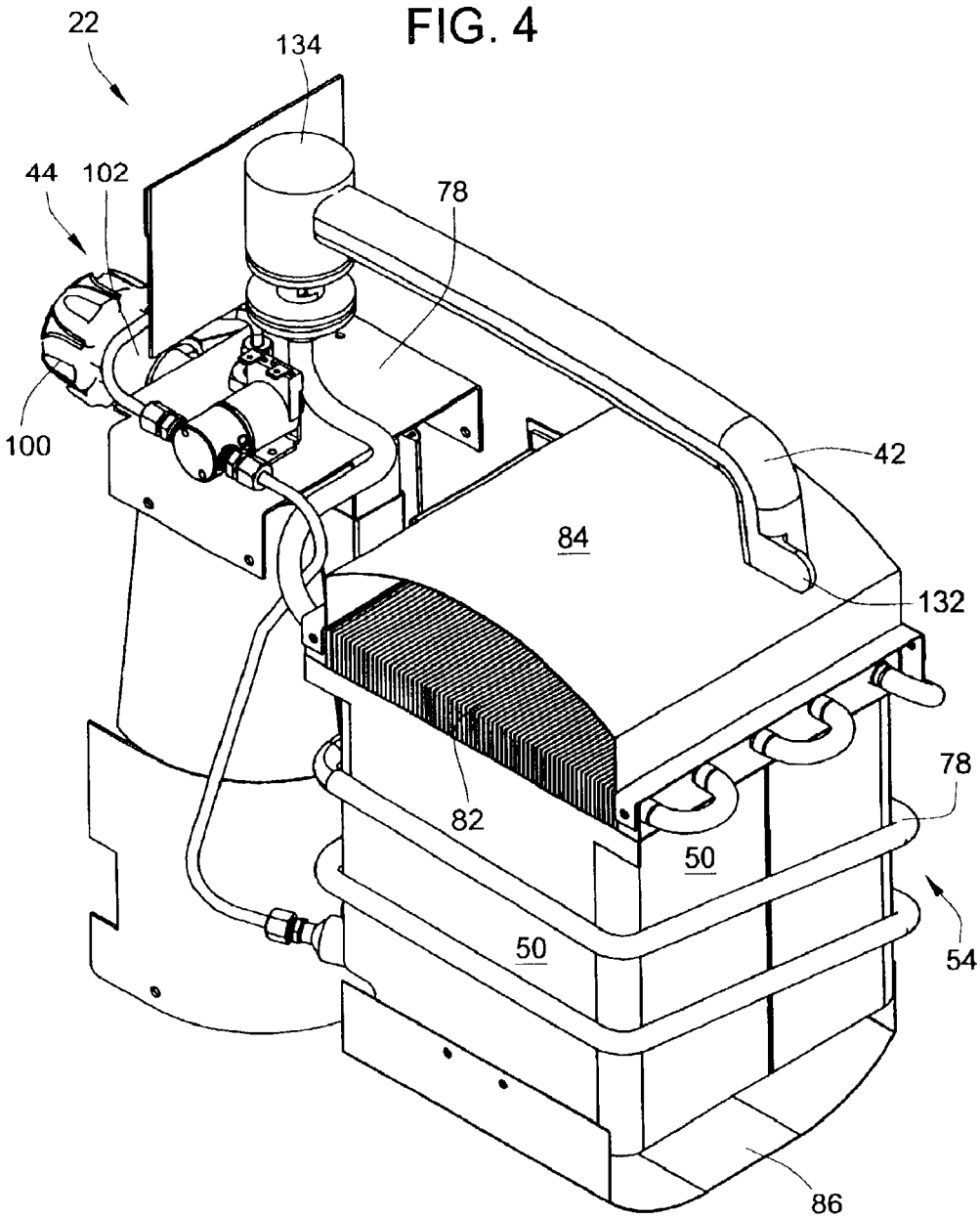
FIG. 4 is a rear right, isometric view of the instant hot water heater of FIG. 1, with parts removed for detail.

In any event, after the base unit 22 and the pump 26 are ready, the user rotates the spout 42 out of the handle 40. If desired, a detente 132 (FIG. 3) or other catch may be provided on the end of the spout 42 for fitting into a gap 133 on the handle 40. The spout may otherwise be temporarily locked into the handle 40. To permit the spout 42 to rotate without breaking the connection of the spout with the tubing 78, the spout 42 may be mounted on an appropriate rotator piece 134 (FIG. 4). Rotating connections that allow fluid to flow therethrough are well known, and a detailed description is not provided here so as not to obfuscate the invention. However, in one embodiment, the rotator piece 134 may be fixed to the spout 42, and the tubing 78 below the spout may be flexible. The spout 42 rotates within a slot 136 on the outside of the base unit 22 until it extends outward as shown in FIG. 1.

After the spout 42 has been rotated outward, the user actuates the control knob 44 by grasping the outer knob 100 and rotating it counterclockwise. A sequence of different stages of movement of the control knob 44 is shown in FIGS. 7–10. In the first half turn of the outer knob 100 (movement from FIG. 7, through FIG. 8, to FIG. 9), the inner knob 102 turns with the outer knob 100. The flow valve lever 116 does not move during this rotation, but instead stays stationary in the same position within the gap 114. In the first quarter of the movement (FIG. 7 to FIG. 8), a switch 138 (FIG. 11) in the regulator shaft 104 turns on the pump 26 and the printed circuit board 70.

During the first two portions of the movement of the control knob 44 (i.e., in the embodiment described, movement from FIG. 7 to FIG. 9), water flows unimpeded through the flow control valve 90. In the first quarter of a turn, the water flows through without being heated. A user will usually move quickly through this portion of movement of the control knob to the second portion. Continued movement of the outer knob 100 past the first quarter turn and into the second portion of movement (i.e., beyond FIG. 8 toward FIG. 9) begins a supply of gas via the regulator 48 to the burner 52 and causes the ignition module 124 to fire.

Although the function, structure, and operation of the regulator 48 and the ignition module are generally known, a general description is given here for the convenience of the reader. To start combustion in the burner 52, the control knob 44 is rotated, in this case in a counterclockwise direction, causing the regulator shaft 104 to rotate. Rotation of the regulator shaft 104 causes two things to happen. First, the rotation of the regulator shaft 104 opens a valve (not shown), permitting the release of propane from the propane tank 46 and into the burner 52. Second, rotation of the regulator shaft 104 causes the ignition module 124 to spark. The spark ignites the propane in the burner 52, causing combustion.

Turning the control knob 44 further counterclockwise in the second portion of movement (i.e., from FIG. 8 to FIG. 9) opens the valve even more, and increases the amount of propane supplied by the propane tank 46, thus increasing the size of the flame in the burner 52. Likewise, clockwise rotation of the control knob 44 while there is a flame in the burner 52 decreases the size of the flame. This flame adjustment may be used to increase or decrease the heat supplied to the heat exchanger assembly 54.

In the second quarter of a turn, the heat exchanger assembly is heated to the extent of the flame size in the heat exchanger assembly 54. Water flowing through the base unit 22 is heated by the heat exchanger assembly. The water flows from the flow control valve 90 through the conductive tubing 78 and around the copper plate 76. As the water flows around the copper plate 76, it is preheated before entering the heat exchanger 82. This preheating of the water prior to it entering the heat exchanger 82 increases the efficiency of heating of water by the heat exchanger assembly 54 and reduces the likelihood of condensation being formed as a result of heating the water. The conductive tubing 78 extending around the sides 80 of the heat exchanger assembly 54 provides additional heating of the water before it enters the heat exchanger 82, increasing the efficiency of the system.

In addition to the preheating effect provided by the copper plate 76, the copper plate minimizes radiated heat on the bottom of the base unit 22. The lower heat shield also enhances protection of the bottom of the base unit 22.

Figure 8:
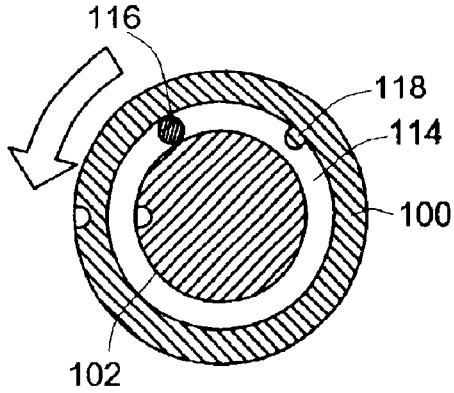
Figure 9:
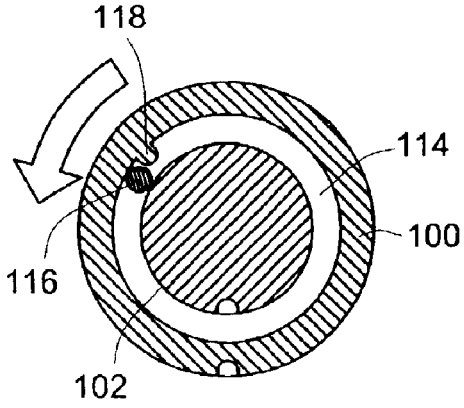
Figure 10:
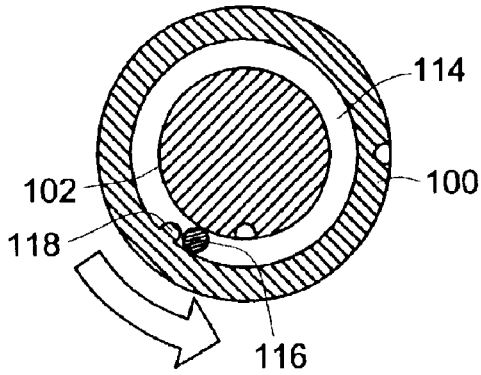

A user may find that water exiting the spout 42 is sufficiently heated when the control knob 44 is in the second range of movement (i.e., between FIG. 8 and FIG. 9). In this range of movement, the user may continue to rotate the knob in the counterclockwise direction, and doing so increases the burner flame, and the heat provided to the heat exchanger assembly 54 and the water flowing through the heat exchanger assembly. At the end of the second range of movement, the flame is at its maximum heat output, because the inner knob 102 cannot rotate any further because the regulator shaft 104 has hits the end of its range of rotation.

If the user wishes to increase the heat of the water even more, the user may continue to rotate the outer knob 100 past the half turn (i.e., counterclockwise beyond FIG. 9). Although the inner knob 102 cannot rotate any further, the user may continue to rotate the outer knob 100 against the action of the torsion spring 106. Simultaneous to the beginning of this movement, the protrusion 118 on the inside of the outer knob 100 engages the end of the flow valve lever 116 and begins to press it downward, driving the opposite end of the flow valve lever 116 upward, along with the push rod 94. When the push rod 94 is driven upward, the rocker arm lever 92 of the flow control valve 90 is also driven upward. This movement of the rocker arm lever 92 causes the flow control valve 90 to begin to restrict the flow of water into the base unit 22. The continued rotation of the outer knob 100 drives the end of the flow valve lever 116 down even further, from the position in FIG. 9 toward the position in FIG. 10, further closing the flow control valve 90. This movement may continue, for example for a 45 degree turn of the outer knob 100, until the flow control valve 90 reaches the low flow stop.

By decreasing the flow of water into the base unit 22, the amount of water that is heated by the heat exchanger unit 54 is decreased. Thus, the heat that is transferred per unit water is increased. As such, the temperature of the water exiting the spout 42 is increased. Although the volume of the water over a defined increment of time exiting the spout 42 would be decreased, the temperature of that water would be higher.

In summary, the control knob 44 provides several operations for the base unit 22 and the pump 26. A first portion of movement of the control knob 44 (in this embodiment, the first quarter turn) causes the pump 26 and the printed circuit 70 to be powered on. A second portion of the movement of the control knob 44 (in this embodiment, the second quarter turn) causes the burner 52 to be lit and adjust the length or output of the flame in the burner. A third portion of movement of the control knob 44 (e.g., a 45 degree turn after the first 90 degrees of motion) decreases the flow of water through the heat exchanger assembly 54, thus increasing the temperature of the water without adding additional heat output. The three different functions for the control knob 44 may be performed by more than one control, or may be performed by a single control that performs one or more of these operations in a different manner. For example, the first portion may be provided by pushing a control knob inward, the second portion by rotating the knob, and a third portion by continued rotation of the knob or movement of the knob downward. However, the described control knob 44 is advantageous in that using the same movement (i.e., rotation of the knob) a user may turn on the instant hot water heater and may be provided a desired temperature of water, without knowing how the operation has occurred, or, if the user turns the control knob into the third portion, that the flow of water has been limited. Other single movement control mechanisms may be used, such as by having a control knob that portions of movement in one direction (e.g., downward) performs each of the three portions of operation for the instant hot water heater 20.

In the embodiment shown, the second portion of operation by the control knob 44 provides a temperature delta of approximately 55° F. between inlet temperature of water and outlet temperature of water at the spout 42. Thus, if water enters the base unit 22 at 65° F., the outlet temperature of the water at spout 42 would be approximately 110° F. If warmer water temperature is desired, the water flow must be reduced. As described above, this operation is accomplished by turning the outer knob 100 into the third portion of operation of the control knob 44, which reduces the flow of water. The low flow stop prevents the flow of water from being so low that the unit would overheat.

If desired, an over temperature control, such as a 170° F. over temperature control 140 (FIG. 8) may be provided. The over temperature control 140 may use a temperature sensing element, such as a thermistor to sense overheating of the heat exchanger assembly 54. The over temperature control 140 may alternatively sense the temperature of water exiting the spout 42. The over temperature control 140 is in a normally closed position, and exceeding an upper limit (e.g., 170° F.) causes the control to open. If desired, an over temperature LED 142 may be provided that is lit when the over temperature control opens to shut off the propane gas valve 50.

Other controls may be provided to protect the base unit 22. For example, a no flame control 144, a low voltage control 146, and a flow sensing switch 148 may all be provided for safety of the base unit 22. The flow sensing switch 148 may determine whether an adequate supply of water is flowing through the base unit 22, the low voltage control 146 may determine whether there is adequate voltage to operate the base unit 22 and the pump 26, and the no flame control 144 may sense whether a flame is operational in the heat exchanger unit 54. For the diagram shown in FIG. 11, each of these switches is in a normally closed position, and opening the switch causes the propane gas valve 50 to close, shutting off flow of gas to the burner 52. If desired, one or more LEDs, such as a low voltage LED 150 may be provided for indicating conditions of the base unit 44.

The printed circuit board 70 may include the necessary control components to operate the functions of the instant hot water heater 20. The printed circuit board 70 may be alternatively be standard control (i.e., a device or mechanism used to regulate or guide the operation of a machine, apparatus, or system), a microcomputer, or any other device that can execute computer-executable instructions, such as program modules. Generally, program modules include routines, programs, objects, components, data structures and the like that perform particular tasks or implement particular abstract data types. A programmer of ordinary skill in the art can program or configure the printed circuit board 70 to perform the functions described herein.

In the described embodiment, it takes about three seconds for heated water to come out of the spout 42 after a user begins operation of the instant hot water heater 20. There is control of the water temperature that exits the spout 42 from inlet temperature to approximately 150° F. To provide this heat of water, the regulator is adjustable from zero fuel to 30,000 Btus. In addition, the flow control valve 90 is adjustable from one gallon per minute to ¼ gallon per minute.

For the described embodiment, a single 16 oz. propane cylinder can produce around 40 gallons of heated water, assuming the flow control valve 90 is not limiting the flow of water. If desired, a user may connect the base unit 22 to a 20 lb. propane cylinder with a hose so that extended use may be provided.

The instant hot water heater 20 provides varying degrees of hot water instantaneously. The instant hot water heater 20 can be transported and may be used in all locations, such as for camping or tailgating, and may be used for many applications including washing dishes, food preparation, making coffee and tea, and washing face and hands.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

What is claimed is:

1. An instant hot water heater, comprising:

a base unit;

a pump for delivering water to the base unit;

a heat exchanger for heating water in the base unit;

a flow control device for restricting the flow of water into the heat exchanger; and a user control for setting the amount of water that the flow control device restricts, the user control comprising a single control knob that controls the amount of water that the flow control device restricts and the amount of heat supplied to the heat exchanger.

2. The instant hot water heater of claim 1, wherein a first portion of movement of the control knob turns on the pump and a heat source for the heat exchanger.

3. The instant hot water healer of claim 2, wherein a second portion of movement of the control knob controls the amount of heat supplied to the heat exchanger.

4. The instant hot water heater of claim 3, wherein a third portion of movement of the control knob controls the amount that the flow control device restricts the flow of water into the heat exchanger.

5. An instant hot water heater, comprising:

a base unit a pump for delivering water to the base unit;

a heat exchanger for heating water in the base unit;

a flow control device for restricting the flow of water into the heat exchanger;

a user control for setting the amount of water that the flow control device restricts, the user control comprising a control knob that controls the amount of heat supplied to the heat exchanger;

wherein a first portion of movement of the control knob turns on the pump and a heat source for the heat exchanger;

wherein a second portion of movement of the control knob controls the amount of heat supplied to the heat exchanger;

wherein a third portion of movement of the control knob controls the amount that the flow control device restricts the flow of water into heat exchanger; and wherein the flow control device comprises an actuator and the control knob comprises:

a first knob connected for operating a beat source for the heat exchanger;

a second knob mounted on the inner knob;

a spring having a bias and mounted between the first knob and the second knob; and a surface on the second knob for abutting the actuator;

wherein the first and second portions of movement is controlled by the second knob rotating the first knob and the third portion of movement is controlled by the second knob overcoming the bias of the spring, the first knob remaining stationary, and the surface abutting and moving the actuator.

6. An instant hot water heater, comprising:

a base unit;

a pump for delivering water to the base unit;

a heat exchanger for heating water in the base unit;

a flow control device for restricting the flow of water into the heat exchanger; and a user control for setting the amount of water that the flow control device restricts, the user control comprising a single control knob that controls the amount of water that the flow control device restricts and the amount of heat supplied to the heat exchanger, wherein a first portion of movement of the control knob controls the amount of heat supplied to the heat exchanger.

7. The instant hot water heater of claim 6, wherein a second portion of movement of the control knob controls the amount that the flow control device restricts the flow of water into the heat exchanger.

8. An instant hot water heater, comprising:

a base unit;

a pump for delivering water to the base unit;

a heat exchanger for heating water in the base unit;

a flow control device for restricting the flow of water into the heat exchanger; and a user control the setting the amount of water that the flow control device restricts, the user control comprising a control knob, wherein a first portion of movement of the control knob controls the amount of heat supplied to the heat exchanger and a second portion of movement of the control knob controls the amount that the flow control device restricts the flow of water into the heat exchanger; and wherein the flow control device comprises an actuator and the control knob comprises:

a first knob connected for operating a heat source for the heat exchanger;

a second knob mounted on the inner knob;

a spring having a bias and mounted between the first knob and the second knob; and a surface on the second knob for abutting the actuator;

wherein the first portion of movement is controlled by the second knob rotating the first knob and the second portion of movement is controlled by the second knob overcoming the bias of the spring, the first knob remaining stationary, and the surface abutting and moving the actuator.

9. An instant hot water heater, comprising:

a base unit;

a pump for delivering water to the base unit a heat exchanger for heating water in the base unit;

a flow control device for restricting the flow of water into the heat exchanger; and a user control for setting the amount of water that the flow control device restricts, the user control comprising a single control knob that controls the amount of water that the flow control device restricts and the amount of heat supplied to the heat exchanger, wherein a first portion of movement of the control knob turns on the pump and a beat source for the heat exchanger.

10. The instant hot water heater of claim 9, wherein a second portion of movement of the control knob controls the amount of heat supplied to the heat exchanger.

11. The instant hot water heater of claim 10, wherein a third portion of movement of the control knob controls the amount that the flow control device restricts the flow of water into the heat exchanger.

12. An instant hot water heater, comprising:

a base unit;

a pump for delivering water to the base unit;

a heat exchanger for heating water in the base unit;

a flow control device for restricting the flow of water into the heat exchanger; and a user control for setting the amount of water that the flow control device restricts, the user control comprising a single control knob that controls the amount of water that the flow control device restricts and the amount of heat supplied to the heat exchanger, wherein a first portion of movement of the user control controls the amount of heat supplied to the heat exchanger.

13. The instant hot water heater of claim 12, wherein a second portion of movement of the user control controls the amount that the flow control device restricts the flow of water into the heat exchanger.

14. An instant hot water heater, comprising:

a burner;

a heat exchanger arranged to be heated by the burner;

a preheating assembly attached to the burner and configured to be heated by the burner; and conductive tubing for water flowing through the heat exchanger the tubing being routed through the preheating assembly and attached to the preheating assembly so that the conductive tubing is heated by the burner and water flows through the tubing routed through the preheating assembly prior to flowing through the tubing into the heat exchanger, thereby preheating the water prior to the water entering the heat exchanger.

15. The instant hot water heater of claim 14, further comprising a housing, wherein the burner, the heat exchanger, and the preheating assembly arc located in the housing.

16. The instant hot water heater of claim 15, further comprising a fuel tank, connected to the burner, and positioned in the housing.

17. An instant hot water heater, comprising:

a burner comprising a base and burner rings;

a heat exchanger arranged to be heated by the burner;

a preheating assembly mounted between the base and burner rings and configured to be heated by the burner; and tubing for water flowing through the heat exchanger, the tubing being routed through the preheating assembly so that water flows through the preheating assembly prior to the heat exchanger, so that water flowing through the preheating assembly is heated by the preheating assembly prior to entering the heat exchanger.

18. The instant hot water heater of claim 17, wherein the preheating assembly comprises a thermally conductive plate.

19. The instant hot water heater of claim 18, wherein the tubing is mounted on an outer circumference of the thermally conductive plate.

20. An instant hot water heater, comprising:

a burner comprising walls having an outer surface;

a heat exchanger mounted within the walls and arranged to be heated by the burner;

a preheating assembly attached to the burner and configured to be heated by the burner; and tubing for water routed through the preheating assembly and adjacent the outer surface of the walls and then through the heat exchanger, so that water flowing through the tubing is preheated by the walls and the preheating assembly prior to entering the heat exchanger.

21. An instant hot water heater, comprising:

a burner comprising walls having an outer surface;

a heat exchanger mounted within the walls and arranged to be heated by the burner; and tubing for water flowing through the heat exchanger, the tubing being routed adjacent the outer surface of the walls so that the tubing is heated by the walls when the burner is operating, the tubing being arranged so that water flowing through the tubing is preheated as is flows through the tubing adjacent the outer surface of the walls prior to the water flowing into the heat exchanger.

* * * * *